United States Patent [19]

Troutner et al.

[11] Patent Number: 4,824,510

[45] Date of Patent: Apr. 25, 1989

[54] METHOD AND APPARATUS FOR ASSEMBLING BOX UNITS

[75] Inventors: Arthur L. Troutner, Boise; Thomas M. Atwood, Kuna, both of Id.

[73] Assignee: Trus Joist Corporation, Boise, Id.

[21] Appl. No.: 125,701

[22] Filed: Nov. 27, 1987

[51] Int. Cl.[4] ..... B25B 1/20

[52] U.S. Cl. ..... 156/288; 144/2 C; 144/3 L; 269/41; 269/243

[58] Field of Search ..... 156/288; 269/37, 40–45, 269/243; 144/2 C, 3 L

[56] References Cited

U.S. PATENT DOCUMENTS 771,825 10/1904 Jordan ..... 269/42 X 4,027,866 6/1977 Ruggiero ..... 269/41

*Primary Examiner*—David Simmons

*Attorney, Agent, or Firm*—Kolisch, Hartwell & Dickinson

[57] ABSTRACT

An apparatus and method for assembling elongate box units are disclosed. The apparatus includes plural, elongate clamping elements which are constructed to define a corner configuration for adjacent side pieces of a box unit. Plural, elongate tensioning rods typically extend through the clamping elements in an array with the rods extending perpendicular to the elongate length of the box unit. The method of the invention teaches the use of the apparatus for forming the elongate box units.

24 Claims, 2 Drawing Sheets

METHOD AND APPARATUS FOR ASSEMBLING BOX UNITS

BACKGROUND OF THE INVENTION

The instant invention relates to the manufacture of box units which are suitable for use as sign posts or lamp standards. More particularly, the invention relates to an apparatus and a method of using the apparatus for constructing such box units.

Road sign supports and street light standards have been provided in a variety of forms. Perhaps the earliest form was the telephone-pole like support, or standard, which was formed from a single tree, turned down to an appropriate diameter. Alternately, steel or aluminum supports or standards have been used, which are usually bolted to rather massive concrete footings.

A serious problem with the previously mentioned forms of supports and standards is the effect of an impact by a motor vehicle on a solid standard. A vehicle, particularly a passenger vehicle, traveling at normal highway speeds, or even normal urban street speeds, will sustain substantial damage by impacting a telephone-pole type of support or standard, and particularly following impact with a metal support or the concrete footing therefore.

Although some metal standards have been provided with break-away features to lessen the damage to the vehicle and the occupants thereof following impact, such standards are quite expensive and, while they may not cause as much damage as a result of the impact, the standard may land on, or otherwise contact, the vehicle following the impact, thereby causing further damage.

Several systems and methods of forming box units are known. One such system is disclosed in U.S. Pat. No. 2,753,902 to Klee and describes a system which utilizes plural clamp blocks which are arranged at the corners of the structure being formed. Klee, however, does not disclose any system or method for gluing plural units simultaneously.

Ferris, U.S. Pat. No. 1,162,759 discloses a gluing clamp which allows the gluing of multiple articles, but does not provide any component to define the corners of the structure being glued.

Sumner, U.S. Pat. No. 3,835,904 discloses an apparatus for laminating wooden strips through the use of an elastic, rather than a rigid beam. Additionally, Sumner does not disclose a system or method that will allow the simultaneous application of uniform force along horizontal and vertical axis.

An object of the instant invention is to provide an apparatus for and a system of assembling a box unit which will act as a sign support or lamp standard, and which will reduce the aforementioned problems. Another object of the instant invention is to provide a method and apparatus of applying pressure, equally along the length of assembled, multiple box units during a gluing process. Yet another object of the instant invention is to provide an apparatus and method of equally tensioning clamping elements disposed in a cluster during a gluing process. Another object of the instant invention is to provide tensioning means which have incremental tension gauges thereon. Still another object of the invention is to provide a clamping apparatus which is inexpensive and easy to manufacture and to provide a method of using the apparatus, which does not require a great deal of skill or time.

SUMMARY OF THE INVENTION

The apparatus of the instant invention is used for assembling elongate box units wherein the box units consist of multiple elongate side pieces which are joined along their long edges. The apparatus includes plural, elongate clamping elements which are constructed and arranged to define a corner configuration for adjacent side pieces of at least one of the box units. The clamping elements may have a cruciform shape and be arranged in a cluster. Also, tensioning means, in the form of plural elongate tensioning rods, may be provided to apply equal tension to the clamping elements when the elements are disposed in such a cluster with box units interspersed therebetween. The rods of the tensioning means typically are of adjustable length and include fastening means, with an increment gauge to indicate the actual working length of the rod.

The method aspect of the invention includes deploying a horizontal cluster of spaced apart, elongate clamping elements, compiling the components of a first layer of plural box units between adjacent clamping elements, deploying a second horizontal array of spaced apart clamping elements on the first layer of box units, laying down additional layers in clusters to assemble a desired quantity of box units, and tensioning, uniformly, with horizontal and vertical clamping forces, the clamping elements.

These and other features and advantages of the invention will become more fully apparent as the description which follows is read in conjunction with the drawings.

DETAILED DESCRIPTION OF THE PREFERRED EMBODIMENT

Figure 1:
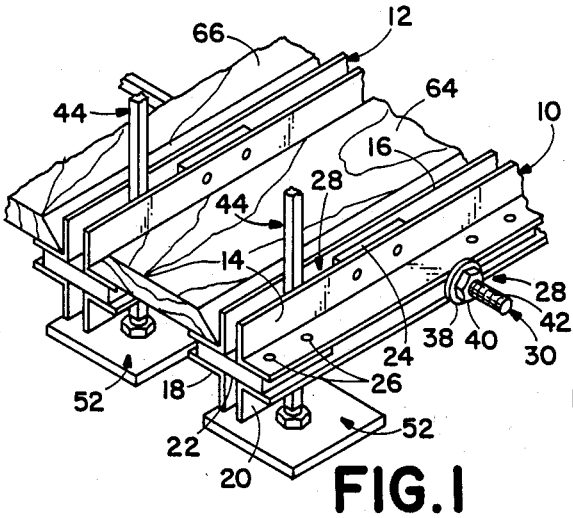
FIGS. 1–3 depict steps in the method of compiling the components in a first layer of box units according to the invention, using the apparatus of the invention.

Referring now to the drawings, and initially to FIG. 1, elongate clamping elements of the invention are shown at 10 and 12. Elements 10 and 12 are part of a cluster of clamping elements, wherein the elements are substantially identically formed pieces which are constructed and arranged to define an external corner configuration for a box unit which is to be constructed using the clamping elements. As described herein, the box units which will be constructed using the method and apparatus of the invention have a substantially square or rectangular cross section, although the apparatus, slightly modified, and method of the invention are equally well suited to forming box units having three or more sides. The preferred embodiment of the apparatus described herein is intended for use with rectangular or square cross section box units and has a cross-like or cruciform cross section.

Figures 6, 7:
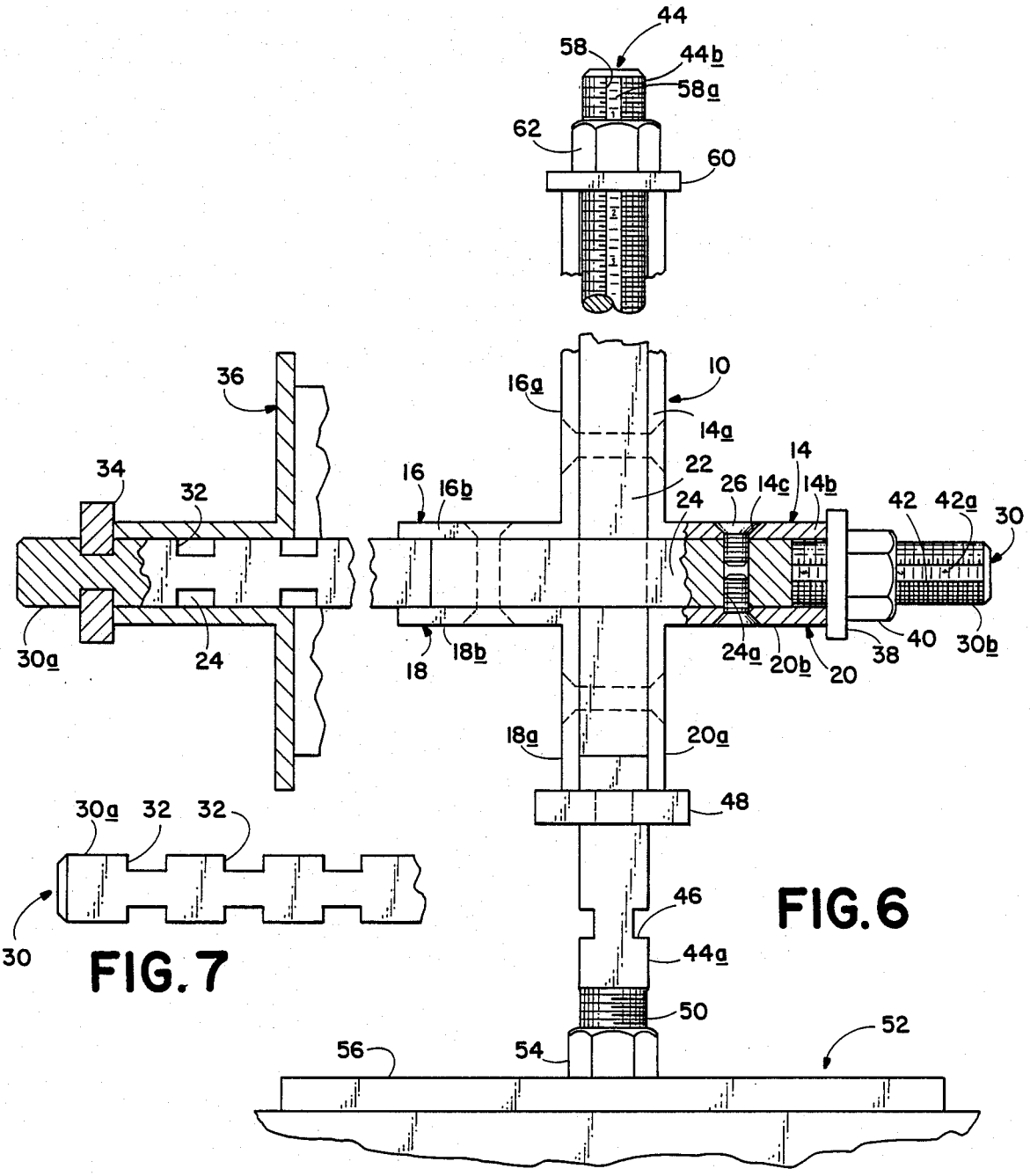
FIG. 6 is an end view of clamping elements and tensioning means of the invention, with portions broken away to show detail.
FIG. 7 depicts one end of a tensioning rod of the invention.

Referring momentarily to FIG. 6, clamping element 10 will be described in greater detail. Element 10, in the preferred embodiment, is formed of four 90° angle bars such as bars 14, 16, 18 and 20. The bars have arms of equal length, such as arms 14*a*, 14*b*. The arms are maintained in a spaced apart relationship by spacers, such as vertically extending spacers 22 and horizontally extending spacers 24. Vertically extending spacers 22 are secured to vertical arms 14*a* and 16*a*, 18*a* and 20*a*, and serve to maintain the arms in their opposed, spaced apart relationship. Horizontal spacers 24 are secured between horizontal arms 14*b* and 20*b*, 16*b* and 18*b*. The spacers are secured to the arms, in the preferred embodiment, by means of fasteners 26 which are received in spacer bores, such as bore 24*a*, which may be tapped to receive a threaded fastener. Fasteners 26, in the preferred embodiment, are flat head bolts, the heads of which are received in countersunk bores, such as 14*c* in arm 14*b*. This configuration provides for a rigid clamping element, which has very low flexure along its length.

Figure 5:
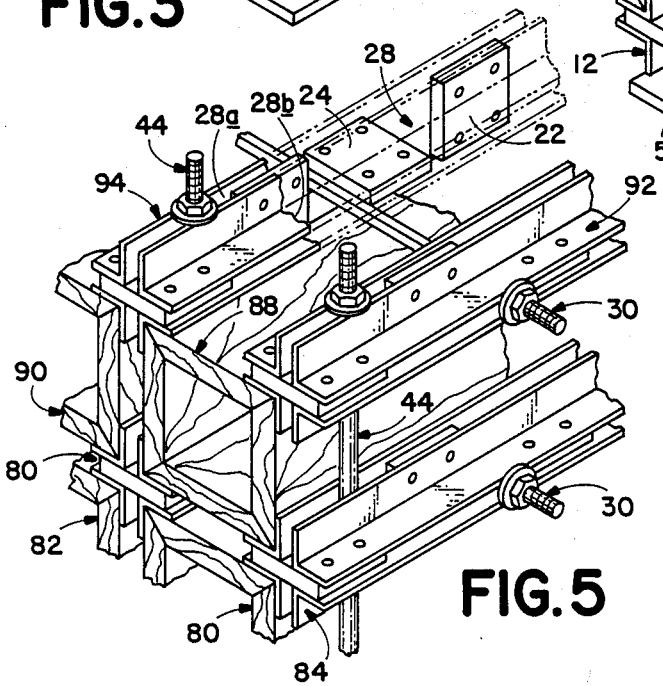
FIG. 5 depicts the formation of additional layers and clusters according to the invention.

The spacers are arranged in the element, and now referring to FIG. 5, such that a gap is present between a vertical and horizontal spacer. This gap, or aperture, 28 is provided to allow the passage of a tensioning rod, such as horizontal tensioning rod 30, through the clamping elements. The apertures extend both horizontally and vertically relative to the element and, in the preferred embodiment, are sized to allow passage of one rod only therethrough. Each aperture includes a horizontal portion 28*b* extending through the center of the element and between horizontal arms 14*b*, 20*b* and 16*b*, 18*b*. Likewise, each aperture also includes a vertical portion 28*a* extending through the center of the element and between arms 14*a*, 16*a* and 18*a*, 20*a*.

Referring again to FIGS. 6 and 7, the tensioning rods, also referred to herein as tensioning means, will be described in greater detail. Horizontal tensioning rod 30 is constructed to provide a means for applying horizontally oriented tension to a cluster of clamping elements, thereby applying pressure to box units received in a cluster. To this end, the rod is of adjustable operable length. Rod 30 has a square cross section in the preferred embodiment and has a series of notches 32 formed at one end 30*a* thereof. An abutment member or means 34 is received in notch 32, also referred to herein as abutment-means receivers. In the preferred embodiment, abutment member 34 is a substantially U-shaped element which is received on one end of the rod, on one side of the cluster, and contacts a first clamping element, such as element 36.

A washer 38 and a nut 40 are received on the other end 30*b* of rod 30 and comprise what is referred to herein as fastening means. The fastening means contacts a second clamping element, such as element 10 on the other side of the cluster from abutment member 34. Abutment member 34 and the fastening means comprise what is referred to herein as means for applying tension, which is operable to apply a predetermined amount of pressure to the assembled box units along their joined edges.

End 30*b* of rod 30 also includes an increment, or tension, gauge 42 which is formed in the metal of the rod. End 30*b* includes threads which cooperate with internal threads of nut 40. Increment gauge 42 is formed below the level of the threads and provides an indication, through the presence of marks 42*a*, of the location of nut 40 and washer 38 relative to end 30*b* of rod 30. This feature will be explained in greater detail later herein.

Still referring to FIG. 6, vertical tensioning rod 44 is constructed similarly to horizontal tensioning rod 30 and is provided to apply vertically oriented tension to a cluster of clamping elements. Rod 44 includes, at one end 44*a*, at least one notch 46 which receives abutment members 48 therein for adjusting the operable length of the rod. Additional notches may be provided if desired. The distal portion of end 44*a* includes a set of threads 50 which are received in a threaded foot plate 52. Foot plate 52, also referred to herein as foot plate means, is easily formed by securing a nut 54 to a flat plate 53, as by welding, thereby to provide the threaded feature of foot plate 52. End 44*a* has, in the preferred embodiment, a square cross section.

The other end 44*b* of rod 44 is threaded and includes an increment gauge 58 which is formed similarly to increment gauge 42. A washer 60 and nut 62 provide fastening means for the vertical tensioning rod. End 44*b* has, in the preferred embodiment, a round cross section. The transition between end 44*a* and end 44*b* occurs along the length of rod 44 at a level above the first cluster of clamping elements. Rods 30 and 44 are sized to be clearance fittable in apertures 28 and to be nonrotatably received in the aperture, to facilitate tightening of nuts 40 and 62.

Method

Referring now to FIG. 1, the initial stages of the method are depicted. Initially, a first horizontal cluster of spaced apart clamping elements are deployed. Sufficient elements may be used to provide corner configurations for a desired number of box units, such as three or four units per layer. The box units so formed will generally have the dimensions of 4×4 inches or 6×6 inches, or a rectangular size of 4×6 inches, for example. As described herein, a total of nine box units will be formed at one time, in a 3×3 unit configuration. This will require a 4×4 cluster of clamping elements. An element up to eight feet in length will provide sufficient clamping forces with clamping rods located at either end of the eight foot length of the clamps. Should it be desired to form longer box units, such may be accomplished provided tensioning rods are inserted at least every eight feet along the structure of the clamping element.

Initially, a set of eight vertical tensioning rods, with foot plates installed thereon, is arranged on a level surface. Abutment members 48 are installed in notches 46 at a uniform height throughout the set of rods.

A horizontal cluster of four clamping elements are next positioned on the vertical tensioning rods, with a tensioning rod being located intermediate and adjacent the ends of each clamping element. Horizontal tensioning rods are next inserted through apertures 28 adjacent and intermediate the ends of the clamping elements. The operable length of the horizontal tensioning rods is adjusted by installation of abutment members 34 in appropriate notches 32. Fastening means are installed on ends 30*b* of horizontal tensioning rods 30 and the clamping elements distributed along the length of the horizontal tensioning rods to allow placement of box units between adjacent clamping elements.

Box units are compiled, in the first layer, by initially preparing the material for the box units. This involves forming the material, which is generally wood, and which is usually laminated veneer lumber into the desired shape and length. One technique of preparing the material is to provide a beveled 45° edge along the elongate side of the material for the box unit and apply glue or adhesive to the beveled edges. Initially, box-bottom-side pieces, such as pieces 64, 66, are laid between adjacent clamping units.

Figure 2:
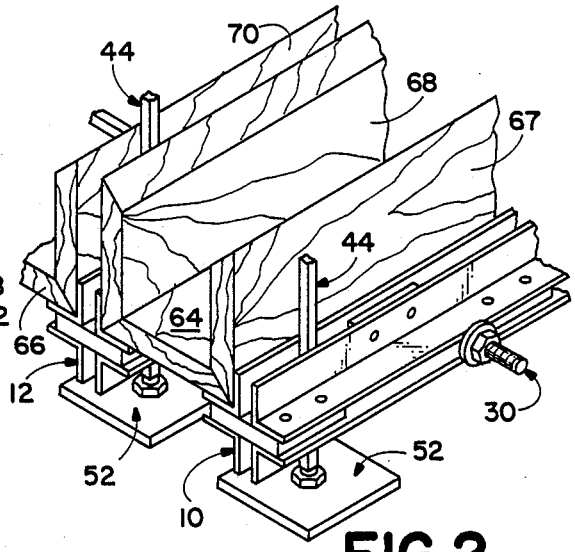

Referring now to FIG. 2, opposed, spaced apart side pieces 67, 68 and 70, are laid on the adhesive coated edges of the bottom pieces.

Figure 3:
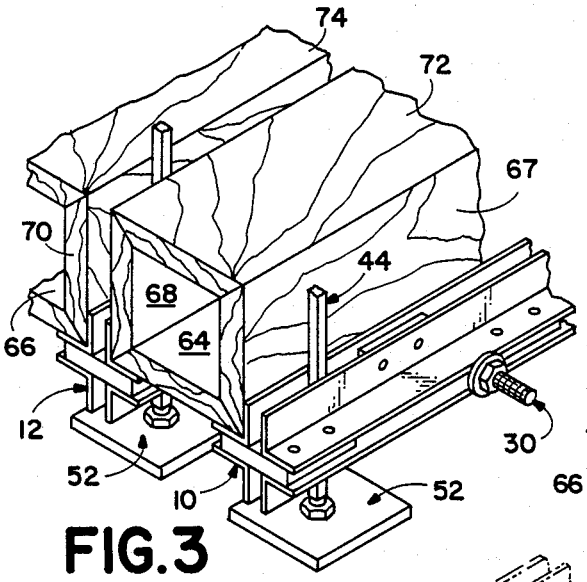

Referring now to FIG. 3, top-side pieces 72, 74 are placed on the side pieces, with the adhesive coated edges in contact. Thus, the first layer of plural box units has been compiled between adjacent clamping elements.

Figure 4:
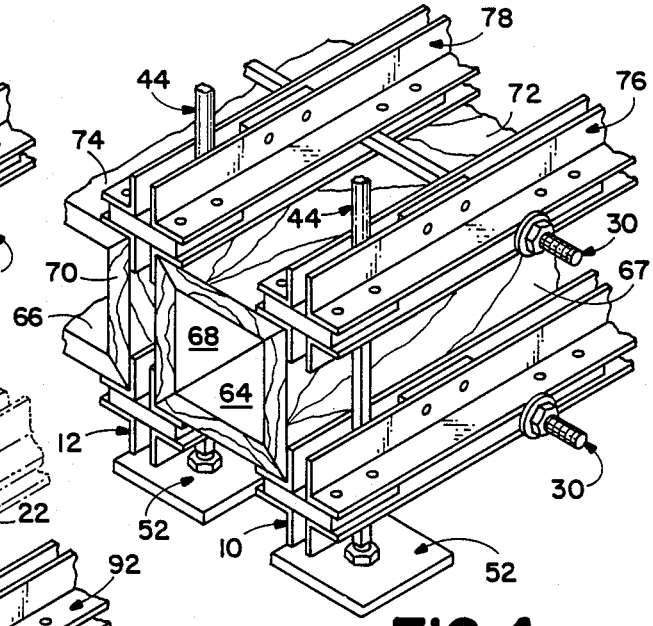
FIG. 4 depicts the beginning step of deploying a second horizontal cluster of clamping elements of the invention according to the method of the invention.

Next, and now referring to FIG. 4, a second horizontal cluster of spaced-apart clamping elements is deployed on the first layer of box units. This second cluster includes elements 76, 78, which are placed such that vertical tensioning rods 44 are received in apertures 28 of the clamping elements. A second set of horizontal tensioning rods is inserted through apertures 28 in the clamping elements to complete the cluster.

Additional layers of box units, such as units 80, 82 may next be laid down and topped with a third horizontal cluster of clamping elements, such as elements 84, 86. A third layer of box units, including units 88 and 90 is next compiled and topped with a fourth horizontal cluster of clamping elements 92, 94. Horizontal tensioning rods 30 are inserted through the clamping elements and fastening means are installed on vertical tensioning rods 44. Nuts 40 and 62 are initially tightened to a snug condition. The vertical and horizontal tensioning rods now form an array, with the rods extending perpendicular to each other wherein the perpendicular array extends perpendicular to the long axis of the box units.

The final step includes applying a predetermined amount of pressure to the assembled box units along their joined units. This is accomplished by tensioning, uniformly the clamping elements by tightening nuts 40 and nuts 62 uniformly, with reference to increment gauges 42 and 58, thereby applying uniform clamping forces to the clamping elements in the cluster. Some device may be provided to uniformly tighten, simultaneously, all of nuts 40 and 62.

In order to apply uniform clamping forces, nuts 40 and 62 are tightened, incrementally, such that the horizontal and vertical forces on the corner joints of the box units remain substantially uniform during the tightening procedure. For instance, increment gauges 42 and 58 are constructed such that a nut tightened to a particular mark of the indicator, such as that shown at 42*a* on indicator 42, would provide the same distance between abutment members 34 and washers 38 as between abutment members 48 and washers 60 on the vertical and horizontal tensioning rods, respectively. Notches 32 and 46 are formed in the tensioning rods to ensure this uniformity.

When the box units have been maintained under pressure for an appropriate amount of time, the fastening means are removed and the cluster of clamping elements separated from the now formed box units. The box units are now ready for finishing which may include painting, or otherwise treating the wood to resist the environment in which the box units will serve.

Thus, an apparatus and method for constructing box units which may serve as break-away sign supports or lighting standards has been disclosed which allows the formation of multiple box units during a single operation. Wiring for lighting fixtures may be trained through the hollow core of the box units.

Box units of virtually any length may be formed, length being limited only by the materials used therein. Side pieces may be constructed such that the ends of the side pieces intermediate the ends of the completed box units are staggered, with additional pieces being butted to the intermediate ends of the side pieces. The individual clamping elements may also be formed in varying lengths and arranged, with suitable tensioning rods, to form a box unit of virtually any length.

Although a preferred embodiment of the apparatus and method of the invention have been described herein, it should be appreciated that variations and modifications may be made thereto without departing from the spirit of the invention.

It is claimed and desired to secure as Letters Patent:

1. An apparatus for assembling elongate box units wherein the box units consist of multiple elongate side pieces joined on their long edges, comprising:

plural, elongate clamping elements, formed from a plurality of formation angles with said formation angles each being equal to the angle of a corner of a box unit to be formed, constructed and arranged to define a corner configuration for adjacent side pieces of at least two of the box units; and plural, elongate tensioning rods extending between said clamping elements in an array, with said rods extending perpendicular to the elongate length of the box units.

2. The apparatus of claim 1 wherein said tensioning rods include means for applying a predetermined amount of pressure to the assembled box units along their joined edges.

3. The apparatus of claim 2 wherein said means for applying pressure includes abutment members located adjacent one end of each rod, for abutting a first of said clamping elements.

4. The apparatus of claim 3 wherein said abutment member includes a substantially U-shaped element received on said one end of each rod.

5. The apparatus of claim 4 wherein said rods include plural, spaced-apart, abutment-member receivers disposed along the length of each rod intermediate the ends thereof for receiving said abutment members for adjusting the operable length of said rods.

6. The apparatus of claim 2 wherein said means for applying pressure includes fastening means located adjacent another end of a rod for abutting a second of said clamping elements.

7. The apparatus of claim 6 wherein said fastening means includes an increment gauge.

8. The apparatus of claim 1 wherein said tensioning rods extend parallel to some of the box unit side pieces and extend perpendicular to others of the box unit side pieces.

9. The apparatus of claim 1 wherein said element includes four 90° angle bars arranged in a cruciform shape, said cruciform shape having equal-length arms and further including spacers located between said bars and fixed to the arms thereof for maintaining said bars in a spaced apart relationship and to maintain said element in a rigid condition along its length.

10. The apparatus of claim 9 wherein said cruciform shaped clamping element includes a pair of substantially equal-length structures crossed in a perpendicular relationship, each structure defining multiple apertures extending therethrough along the respective axis thereof, said apertures being sized to accommodate said rods, said clamping elements being constructed and arranged to be rigid along their lengths.

11. The apparatus of claim 1 wherein said clamping elements are constructed and arranged to define an external corner configuration for adjacent side pieces.

12. An apparatus for assembling box units comprising:

a cluster of plural, elongate clamping elements, each element having a cruciform cross section; and tensioning means extending between said clamping elements, constructed and arranged to apply equal tension to said clamping elements when said elements are disposed in said cluster with box units interspersed therebetween.

13. The apparatus of claim 12 wherein each of said clamping elements is formed of a pair of perpendicularly intersecting arms, with each of said arms being of equal-length and having sides formed in an opposed, spaced apart relationship, and including spacer means disposed between said sides to maintain said relationship, said clamping elements defining apertures extending through opposed arms.

14. The apparatus of claim 13 wherein said spacer means extend between opposed arms of said clamping elements.

15. The apparatus of claim 12 wherein said tensioning means includes plural, elongate tensioning rods extending through said clamping elements, one end of each rod having an abutment member thereon for abutting a clamping element on one side of said cluster and the other end of each rod having fastening means thereon for abutting a clamping element on the other side of said cluster.

16. The apparatus of claim 15 which further includes an increment gauge located at said other end of each rod.

17. The apparatus of claim 15 wherein each of said rods include plural, spaced-apart, abutment-member receivers disposed along the length of said rod intermediate the ends thereof for receiving each of said abutment members, for adjusting the operable length of said rods.

18. The apparatus of claim 17 wherein each of said abutment members includes a U-shaped element which is constructed and arranged to be clearance fittable in said receiver.

19. A method of assembling plural, elongate box units comprising:

deploying a horizontal cluster of spaced apart, elongate clamping elements which define an external corner configuration of a box unit;

compiling the components of a first layer of plural box units between adjacent clamping elements, deploying a second horizontal cluster of spaced apart clamping elements on the first layer of box units;

laying down additional layers and clusters to assemble a desired quantity of box units; and tensioning, uniformly, along the length of the cluster, with horizontal and vertical clamping forces, the clamping elements.

20. The method of claim 19 wherein said deploying of the first cluster includes;

arranging a set of vertically oriented tensioning rods;

positioning the clamping element on at least two vertical tensioning rods, the rods being located intermediate the ends of a clamping element; and inserting horizontal tensioning rods intermediate the ends of the clamping elements.

21. The method of claim 20 wherein said arranging includes installing foot plates on the vertical tensioning rods.

22. The method of claim 20 wherein said arranging includes installing an element-abuting stop on the vertial tensioning rods.

23. The method of claim 20 wherein said inserting includes adjusting the operable length of the horizontal tensioning rods to accommodate a desired quantity of box units.

24. The method of claim 19 whereinsaid compiling includes:

preparing the material for the box units;

applying adhesive to the facing edges of the pieces;

laying a box-bottom-side piece between adjacent clamping units.

laying opposed, spaced apart side pieces on the bottom piece; and laying a top-side piece on the side pieces.

* * * * *